US005423144A

United States Patent [19]

Santos

[11] Patent Number: 5,423,144

[45] Date of Patent: Jun. 13, 1995

[54] WINDOW WITH SLIDING AND PIVOTED PANES

[76] Inventor: Juana M. Santos, Dr. Letamendi 98-100, 08031 Barcelona, Spain

[21] Appl. No.: 169,975

[22] Filed: Dec. 17, 1993

[30] Foreign Application Priority Data

Dec. 31, 1992 [ES] Spain ..... 9203834
Dec. 31, 1992 [ES] Spain ..... 9203835

[51] Int. Cl.[6] ..... E05D 15/22

[52] U.S. Cl. ..... 49/189; 49/175; 49/194; 49/195

[58] Field of Search ..... 49/189, 188, 174, 175, 49/177, 178, 179, 180, 194, 195, 149

[56] References Cited

U.S. PATENT DOCUMENTS

| | | | |
|---|---|---|---|
| 1,954,797 | 4/1934 | Carl | 49/195 X |
| 2,026,119 | 12/1935 | Benzenberg | 49/175 X |
| 4,222,201 | 9/1980 | Yanessa | 49/189 |
| 4,592,168 | 6/1986 | Struckmeyer . | |
| 4,888,915 | 12/1989 | Goldenberg | 49/177 X |
| 5,058,321 | 10/1991 | Harbom et al. | 49/177 |
| 5,065,544 | 11/1991 | Martin | 49/177 |
| 5,119,592 | 6/1992 | Westfall . | |

FOREIGN PATENT DOCUMENTS

| | | |
|---|---|---|
| 1255400 | 1/1961 | France . |
| 1296836 | 5/1962 | France . |
| 2675190A1 | 10/1992 | France . |

*Primary Examiner*—Philip C. Kannan
*Attorney, Agent, or Firm*—McGlew and Tuttle

[57] ABSTRACT

A window including sliding and pivoted panes with a first lateral section and a second lateral section. An upper U-shape guide with a detachable leaf and a lower U-shape guide with a detachable leaf are provided. Central separating sections are positioned in the lower U-shaped guide. The central separating sections are removable from the lower U-shape guide, the panes sliding in the upper U-shaped guide and the lower U-shaped guide on each side of the separating section. Inserted sections are provided connected to each of upper and lower edges of the pane, each of the inserted sections have rolling components and have a semi-shaft movable between a retracted position within one of the inserted sections and a protruded position. Each of the guides have drilled holes for receiving the semi-shaft in the protruded position. A device is provided for moving the semi-shaft between the retracted position and the protruded position.

7 Claims, 3 Drawing Sheets

FIG. 2
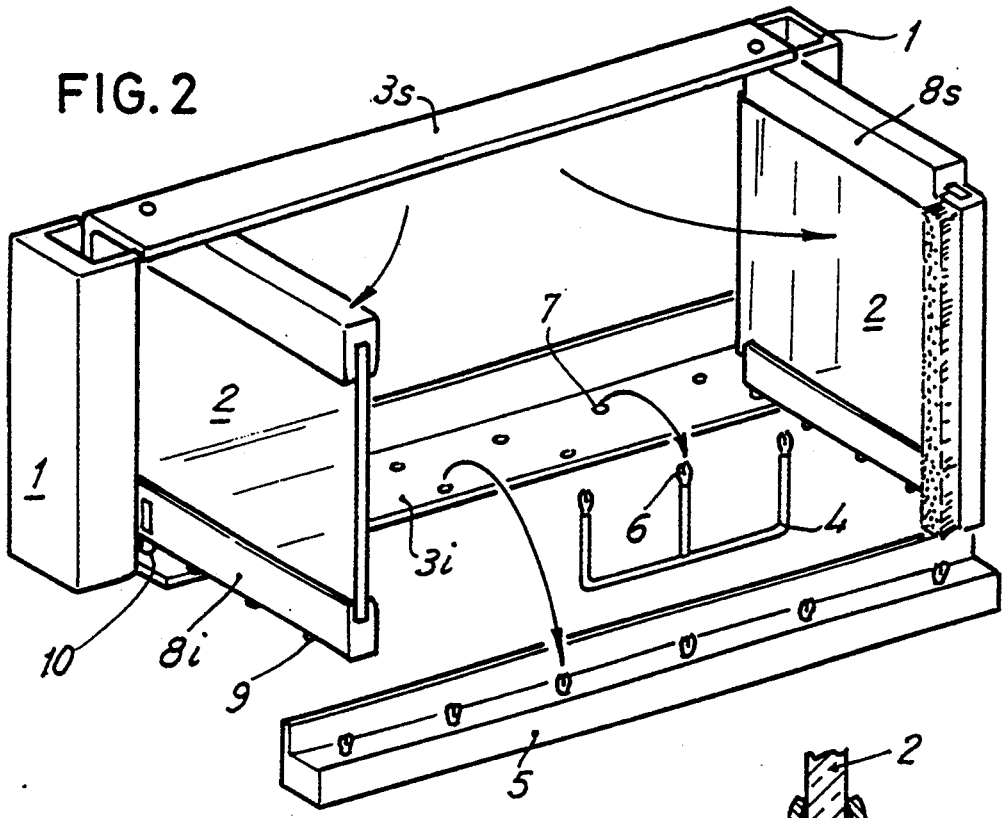
FIG. 3
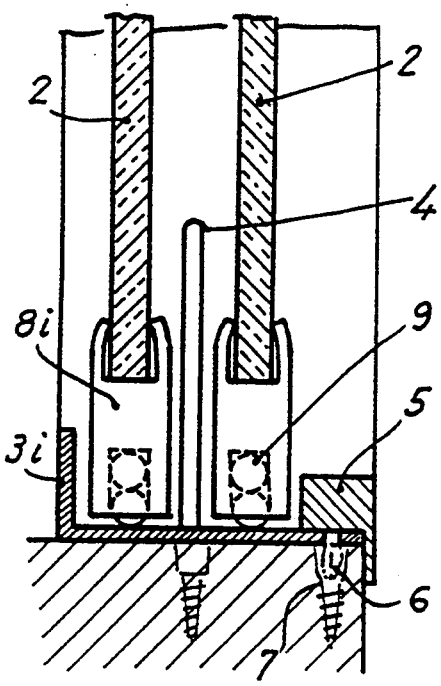
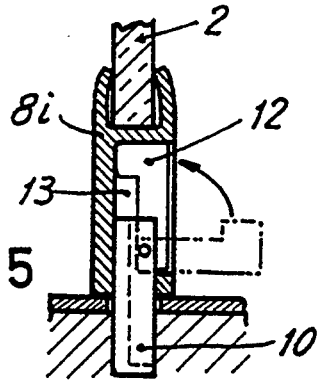
FIG. 5
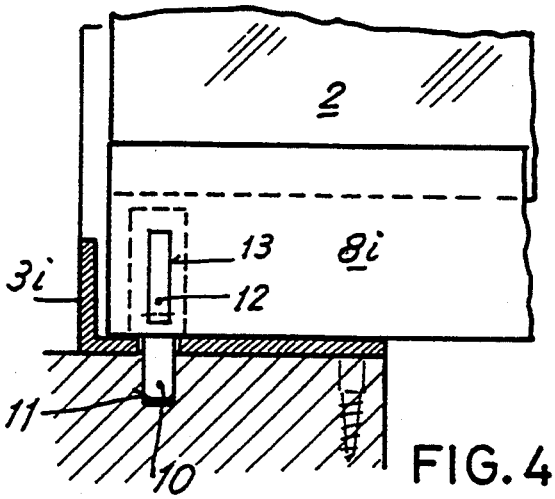
FIG. 4

FIG. 6
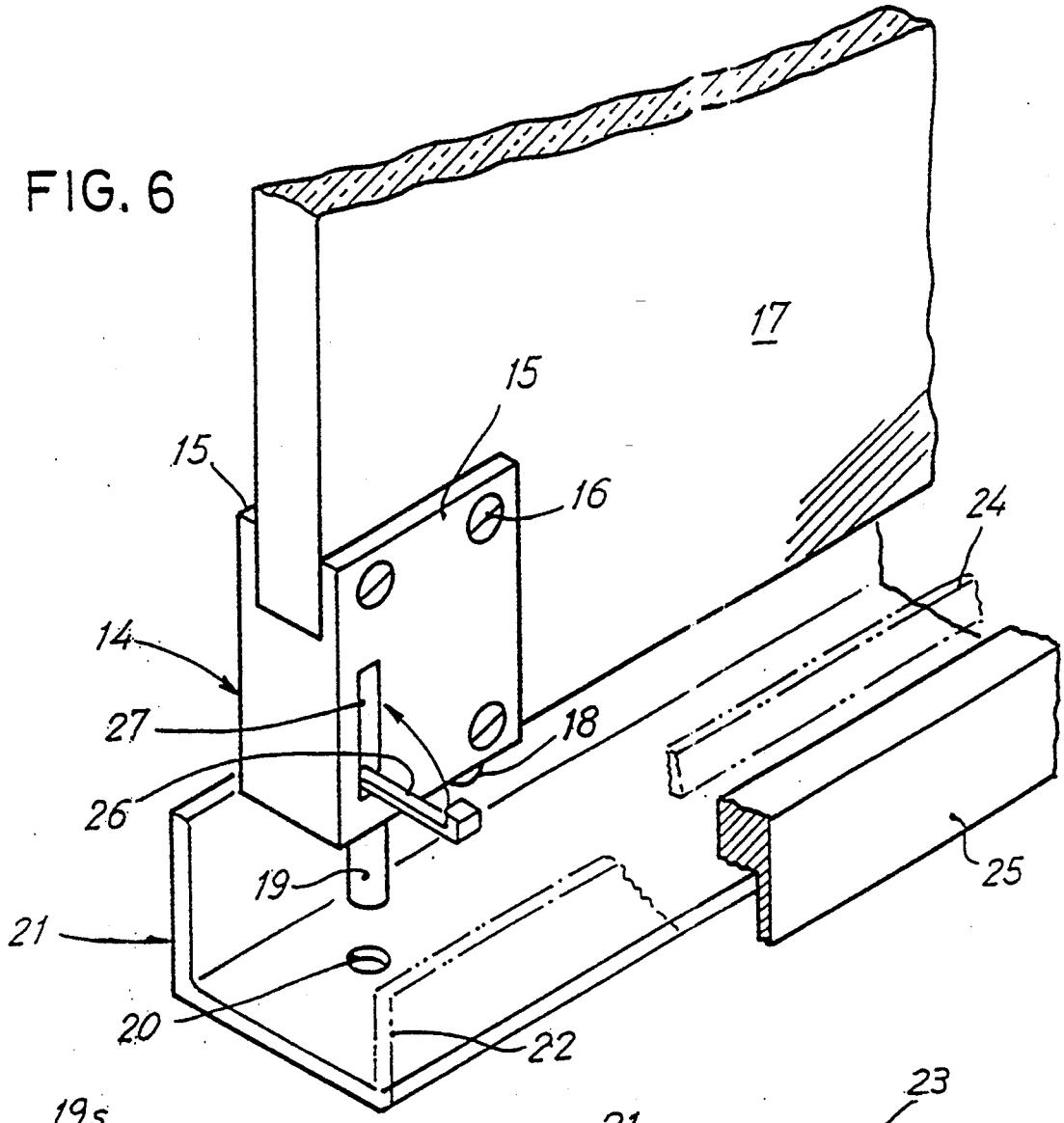
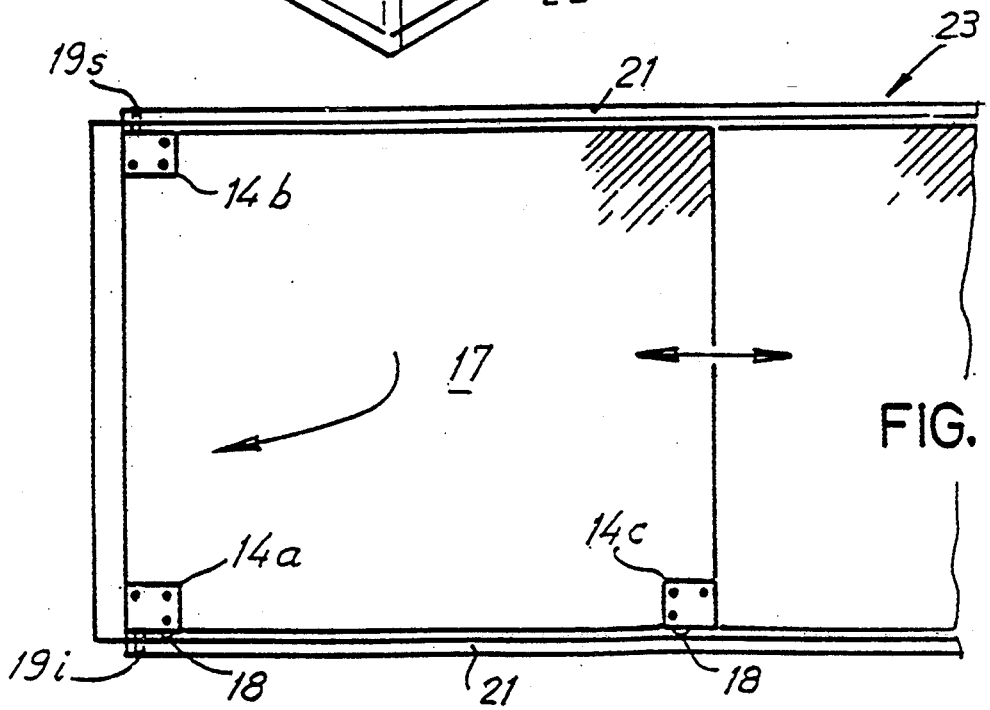
FIG. 7

WINDOW WITH SLIDING AND PIVOTED PANES

FIELD OF THE PRESENT INVENTION

The present invention pertains to a new type of window with sliding and pivoted panes, which offers many convenient advantages, especially concerning the cleaning of same.

PRIOR-ART OF THE PRESENT INVENTION

In fact, windows with sliding glass panes, such as those windows described in EP-0,398,854-A2 and ES-492,899, which basically consist of two longitudinally sliding, glazed panes, and which present a serious disadvantage which is the existence of the panes themselves on their guides, as well as the essentially "U" shape of the guides, as can be seen in ES-U-9,100,929, are already currently known. This design results in one face of the panes invariably remaining located on the outside of the building, which represents a high risk when the person who performs the cleaning has to lean out on the outside to a considerable extent.

The same problem brought about by the guides appears in the vertically slidable windows, as described in ES-P-8,801,502, which, despite having a certain tilt, are not suitable for one being able to perform the cleaning of the outer face comfortably and without risks.

Also known are EP-0,281,062-A1 and EP-0,296,088-A1, which basically provide one window pane that can perform a certain inclination in relation to its frame, on the basis of very complicated iron fittings, and which seems intended more for providing a ventilation opening than for facilitating the cleaning of the outer face of the window pane.

SUMMARY AND OBJECTS OF THE INVENTION

It is an object of the present invention to obtain a window or window shutter, which, while having a definite detachable feature, permits an accurate cleaning of the unit, and also incorporates means for making it possible to pivot the panes, whereby the complete cleaning tasks are extremely simple. Also, with the pivoting, both faces of the window panes remain on the inside of the building, making it possible to clean them comfortably without risks of danger.

The present invention is achieved in a simple manner on the basis of front parts of the upper and lower detachable guides, a likewise detachable component for separating the panes, and the incorporation of lower and upper sides of the pane which have bearings for sliding the pane itself and semi-shafts capable of being retracted in order not to obstruct the sliding or else to make them protrude for inserting them into a respective opening of the guide, within which they can pivot, according to the hinge, with the window pane pivoting in its turn, which is separated from the guide, leaving it free for its complete cleaning.

On the other hand, there are a great number of windows with sliding panes which are already installed, whose replacement with a new window of the type described, will obviously not have any effect, since an adapter device is also provided. The adapter device basically consists of a series of similar pieces, with each piece being incorporated in respective corners of the sliding pane of the window. Each piece consists essentially of a block, which has a bearing for facilitating the longitudinal sliding of the pane on the guide itself, and/or a semi-shaft which is capable of being retracted in order not to obstruct the sliding or else to protrude in order to insert it into an opening of the guide. Within the guide the semi-shaft can pivot, with the window pane pivoting in its turn, which is separated from the guide. This leaves the pane free for its complete cleaning, while both faces of the panes remain on the inside of the building, which facilitates the cleaning without risks of danger.

BRIEF DESCRIPTION OF THE DRAWINGS

For the purpose of facilitating the description, a few pages of drawings, on which an exemplified practical embodiment is represented, are attached to the present specification.

In the drawings:

FIG. 2 is another view similar to FIG. 1, but with the window mounted and with its panes opened and ready for cleaning;

FIG. 3 is a cross section of the same window with its panes in the gliding or sliding position;

FIG. 4 is another cross section of the same window, showing one of its panes in the pivoted position;

FIG. 5 is a detail of a semi-shaft and means for its immobilization;

FIG. 6 is a perspective view of a corner of a sliding pane of a conventional window, to which the device provided by the present invention has been adapted; and FIG. 7 is a front view of a pane having the respective devices as shown in FIG. 6 in various corners.

DETAILED DESCRIPTION OF THE PREFERRED EMBODIMENT

Figure 1:
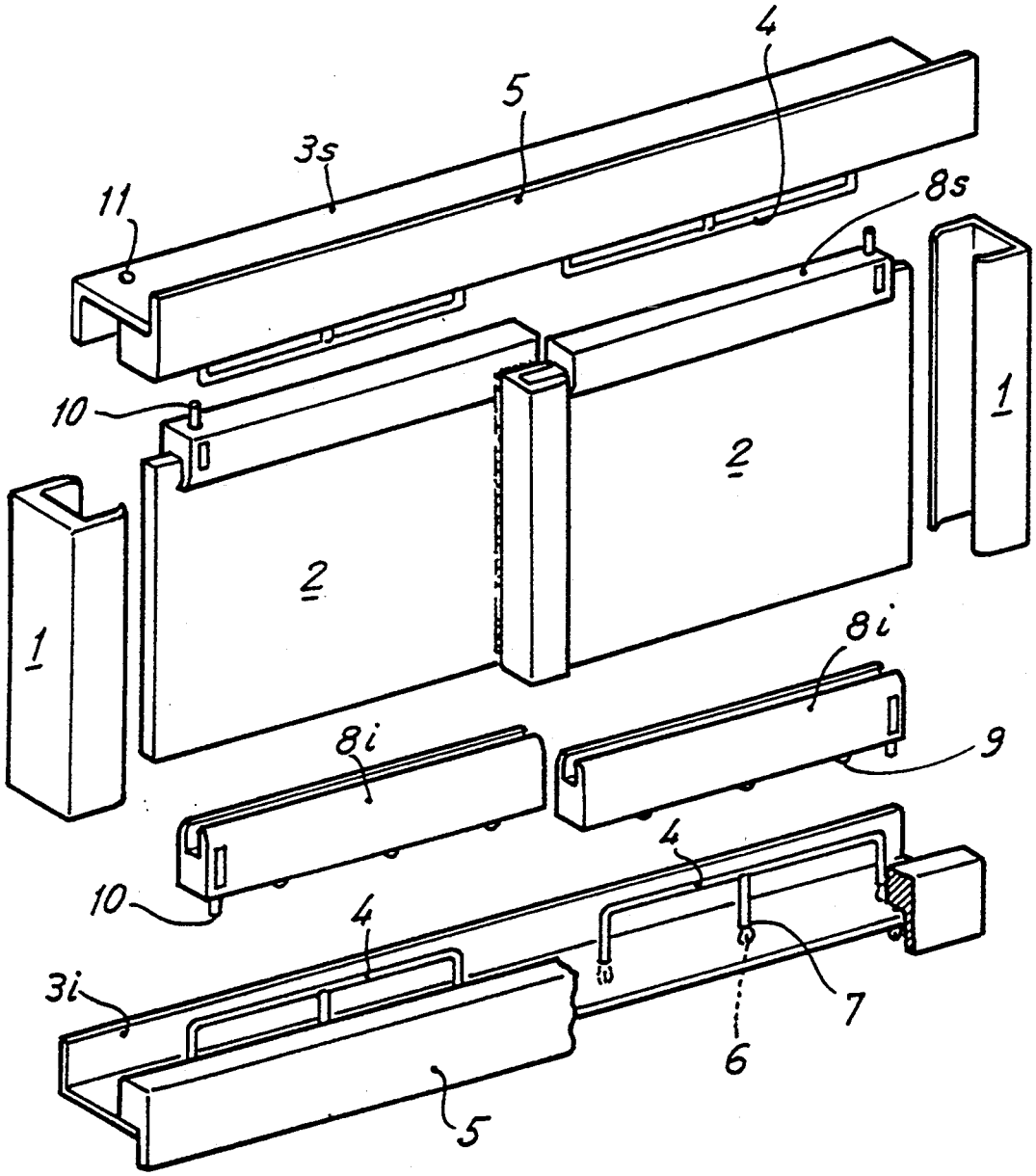
FIG. 1 is a perspective view of the window in the semi-fragmented state.

Referring to the drawings in particular the window with sliding and pivoted panes of the present invention includes two lateral "C"-shaped sections 1 between which are arranged the sliding panes 2, which are slid along the base guides 3*i*, 3*s* of an "L"-shaped section on both sides of a central separating component 4.

It is fundamental that both this separating component 4 and a front leaf 5, which encloses the base guides 3*i*, 3*s*, have multiple pivots 6, which under pressure can be plugged into corresponding drilled holes with elastic bushing 7 of the base guides 3 of the "L"-shaped sections.

On the other hand, the lower and upper edges or sides of the panes 2 have a respective "U"-shaped section 8, which is provided with rolling components 9, such as balls or rollers, which facilitate the sliding of the panes proper 2, as well as semi-shafts 10, which, together with the drilled holes 11 of the base guide 3 proper, make a hinge for the panes 2.

With such a design, when the window needs to be cleaned, it is sufficient to detach the leaves 5 and the separating sections 4, to slide the panes 2 until the semi-shafts 10 are inserted into the respective drilled holes 11 of the lower base guide 3*i* and the upper base guide 3*s*, to pivot the panes 2 and to leave the path completely free for the required cleaning.

Means have been provided for setting the position given to the semi-shafts 10, the means consisting of an appendage or small lever 12, which is articulated with the semi-shaft proper 10 and is capable of protruding in order to operate the same semi-shaft or else to move it and to insert it into the groove 13, whereby the same small lever ends in the ends of the groove 13, preventing the semi-shaft 10 from being concealed. The lever 12 is moved up or down to move the semi-shaft 10, to retract or to have the semi-shaft 10 protrude.

It is noted that the upper sides 8*s* of the panes 2 do not have rolling components; in fact, the rolling components may be omitted thanks to the free movement which must exist between the sides and the upper guide 3*s*, and to the fact that the only gravity falls on the lower base guide 3*i*.

On the other hand, it is obvious that the drilled holes 11 for the semi-shafts 10 can be at any point along the length of the base guides 3*s*, 3*i* for the corresponding pane to be able to pivot at the most advantageous point of the window or window shutter proper.

In the same manner, for current windows (FIG. 6), an adapter device has been provided for the sliding and pivoting of window panes, the panes consisting, in the first place, of a section in the form of a block 14 with leaves 15 for attaching it by means of screws 16 in a respective corner, to be cut away, of each glass pane 17, and which incorporates a small bearing 18, which may be either a double ball or a roller, as well as a semi-shaft 19, which is capable of concealing it for when it is desirable that the pane be slid normally to the left or to the right, and of making it protrude in order that it may pivot within a hole 20 which has been made appropriately in the position corresponding to the guide 21, forming the joint of the pane 17 of the window 23.

For this reason, it is essential beforehand to remove both the upper and lower intermediate separating sections 24 and the front leaf 22 of the guide, with the purpose of permitting the pivoting of the pane proper 17 towards the inside, and then, once the panes are in the sliding position, placing a detachable leaf or parapet.

Each semi-shaft 19 is provided with an appendage 26 which can be folded or raised; when the appendage is raised, it is concealed in the opening 27, preventing the semi-shaft 19 from being able to be retracted accidentally or at the wrong time. The lever 26 is moved up or down to move the semi-shaft 19, to retract or to have the semi-shaft 19 protrude.

It is seen (FIG. 7) that the device 14a of one lower corner requires the semi-shaft 19 and the bearing 18; the device 14*b* of the upper corner of the same side only requires the other semi-shaft 19*s*, while a rolling component 18 is only necessary for the block 14c of the other lower corner.

While specific embodiments of the invention have been shown and described in detail to illustrate the application of the principles of the invention, it will be understood that the invention may be embodied otherwise without departing from such principles.

What is claimed is:

1. A window, comprising:

sliding and pivoted panes;

a first lateral section and a second lateral section;

an upper U-shape guide with a detachable leaf;

a lower U-shape guide with a detachable leaf;

central separating sections positioned in said lower U-shaped guide, said central separating sections being removable from said lower U-shape guide, said panes sliding in said upper U-shaped guide and said lower U-shaped guide on each side of said separating sections;

sections connected adjacent to each of upper and lower edges of said panes, each of said inserted sections having rolling components and having a semi-shaft movable between a retracted position within one of said inserted sections and a protruded position, each of said guides having drilled holes for receiving said semi-shaft in said protruded position; and setting means for moving said semi-shaft between said retracted position and said protruded position.

2. A window according to claim 1, wherein said sections include an upper u-shaped section and a lower u-shaped section.

3. A window according to claim 1, wherein:

said setting means includes an appendage articulated to said semi-shaft and positionable protruding from a groove of an associated one of said inserted sections or being concealed within said groove.

4. A window according to claim 1, wherein:

said sections comprise blocks, each of said blocks being provided with lateral blades attachable to a corner cut away from the window pane to provide an adapter device for already existing windows.

5. A window according to claim 4, wherein:

said setting means includes an appendage articulated to said semi-shaft, said appendage being movable between a position protruding from an opening of said block to a position within said opening of said block.

6. A window adapter device provided for the sliding and pivoting of window panes of conventional, already existing windows, said device comprising:

a plurality of blocks, each of said blocks being provided with lateral blades attachable to a corner cut away from the window pane, said blocks including a first and second lower block;

a rolling component provided in each of said first and second lower block;

a semi-shaft supported in each of said first and second lower block, said semi-shaft being positionable in a retracted position and a protruded position; and setting means for moving said semi-shaft between said retracted position and said protruded position.

7. A window adapter according to claim 6, wherein:

said setting means includes an appendage articulated to said semi-shaft, said appendage being movable between a position protruding from an opening of said block to a position within said opening of said block.

* * * * *

UNITED STATES PATENT AND TRADEMARK OFFICE

CERTIFICATE OF CORRECTION

PATENT NO. : 5,423,144

DATED : June 13, 1995

INVENTOR(S) : Juana MUÑOZ SANTOS

It is certified that error appears in the above-identified patent and that said Letters Patent is hereby corrected as shown below:

On the title page of the Letters Patent, please correct the name of the inventor as follows:

[76] Inventor: Juana Muñoz Santos, Dr. Letamendi 98-100, Barcelona, Spain

Signed and Sealed this

Nineteenth Day of September, 1995

*Attest:*

*Attesting Officer*

BRUCE LEHMAN

*Commissioner of Patents and Trademarks*